United States Patent [19]

Arendt et al.

[11] Patent Number: 4,642,965

[45] Date of Patent: Feb. 17, 1987

[54] DEVICE FOR AUTOMATICALLY ATTACHING AN ARROW LABEL

[75] Inventors: Gerhard Arendt, Hohentengen; Klaüs-Peter Brodbeck, Singen; Reinhold Engenhart, Mengen; Viktor Schmidt, Saulgau; Klaus Wedler, Mittelbiberach, all of Fed. Rep. of Germany

[73] Assignee: Croon & Lucke Maschinenfabrik GmbH & Co. KG, Fed. Rep. of Germany

[21] Appl. No.: 701,506

[22] Filed: Feb. 14, 1985

[30] Foreign Application Priority Data

Feb. 24, 1984 [DE] Fed. Rep. of Germany ..... 3406635

[51] Int. Cl.[4] ..... B65B 61/20; B65B 63/04

[52] U.S. Cl. ..... 53/118; 53/128; 53/581

[58] Field of Search ..... 53/410, 430, 409, 116, 53/128, 204, 585, 581, 118; 206/388, 392, 417; 29/450

[56] References Cited

U.S. PATENT DOCUMENTS 4,055,934 11/1977 Leveugle ..... 53/585

4,287,657 9/1981 Andre et al. ..... 29/450

*Primary Examiner*—John Sipos

*Attorney, Agent, or Firm*—Leydig, Voit & Mayer

[57] ABSTRACT

The disclosure describes a method of automatically attaching an arrow label in the center hole of a ball, skein or package of yarn or thread wound onto a winding mandrel. The arrow label is coaxially aligned with the winding mandrel. During withdrawal of the ball of yarn from the winding mandrel the ball slides with its center hole onto the label. Subsequently, the ball of yarn is transported away together with the label by a conveyor means. A device for carrying out this method is provided with a movable label conveyor which positions the arrow labels one at a time and tip first at the winding mandrel. A movable gripping device then withdraws the ball of yarn from the winding mandrel, slides it over the shaft of the arrow label and transfers the labelled ball to ball conveyor.

4 Claims, 7 Drawing Figures

11
18
11
11
24
1
2
12
31
23
21
13
25
17
22
14
16
15
26
1
29
27
11
28

11
18
11
11
24
1
2
12
31
23
21
13
25
17
22
15
16
14
26
1
29
27
11
28

11
18
11
11
24
1
2
12
31
23
21
13
25
17
22
16
15
14
26
1
29
27
11
28

DEVICE FOR AUTOMATICALLY ATTACHING AN ARROW LABEL

The invention relates to a device for automatically attaching an arrow label in the center hole of a ball, skein or package of yarn or threadwound on a winding mandrel.

It is known to attach arrow labels to balls, skeins or packages of yarn or thread, in particular when flat, whereby the barbed shaft of the label is inserted into the center hole of the ball. This was previously done by hand and thus required a considerable amount of working time and a large number of personnel.

The object underlying the invention is to specify a device for automatically attaching arrow labels to balls of yarn or thread which have been wound on a winding mandrel.

The object is accomplished in accordance with the invention as follows:

A. The arrow label is brought tip first into the immediate vicinity of the free end of the winding mandrel and is thereby aligned substantially coaxially with the winding mandrel;

B. the ball of yarn or thread is withdrawn from the winding mandrel such that it slides with its center hole onto the arrow shaft of the stationary arrow label;

C. the ball of yarn or thread is displaced with the arrow label inserted therein onto a conveyor means and transported away.

The idea underlying the invention is therefore to use the procedure of withdrawing the ball from the winding mandrel, which has to be done anyway, for simultaneously sliding the ball with its center hole onto the shaft of the arrow label. It is then merely necessary for the arrow label to be brought into the required position at the free end of the winding mandrel.

In accordance with the invention, a device for automatically attaching an arrow label in the center hole of a ball, skein, or a package of yarn or thread may comprise a winding mandrel having a free end for winding the yarn in a ball, a movable label conveyor for positioning one arrow label at a time, tip first, in the immediate vicinity of the free end of the winding mandrel and aligning the arrow label with the center hole of the ball, a gripping assembly for gripping the ball while on the mandrel, and a mechanism for moving the gripping assembly to withdraw the ball of yarn from the winding label, for sliding the ball of yarn onto the shaft of the arrow label, and for transferring the ball of yarn with the label to a ball conveyor.

Figure 7:
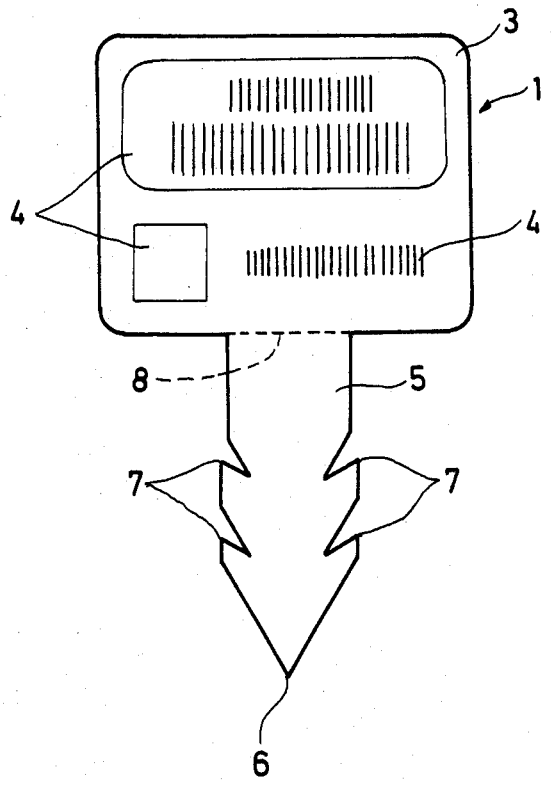

The following description of a preferred embodiment of the invention serves to explain this invention in greater detail in conjunction with the drawings, in which FIGS. 1 to 6 are schematic illustrations of a device for automatically attaching an arrow label to a ball of yarn or thread in various operating positions and FIG. 7 shows an arrow label.

The device illustrated in FIGS. 1 to 6 has a supply of arrow labels 1 stored in a magazine 2. The container forming this magazine 2 is open at the bottom and so the arrow labels which are supported merely by a narrow ledge at the base of the container may be removed downwardly. FIG. 7 shows the shape of a typical arrow label 1. This label consists of a wide label portion 3 with the customary imprint 4. The label portion 3 is connected to an arrow shaft 5 having a tip 6 and barbs 7.

The arrow label 1 is inserted tip first into the center hole of a ball, skein or package of yarn or thread. The barbs 7 which catch in the innermost windings of the ball prevent the label being withdrawn out of the center hole of the ball. The label portion 3 may be folded along the broken line 8 at right angles in relation to the arrow shaft 5 so that it lies against one end face of the ball which has, if required, been pressed flat.

With the aid of the device illustrated in FIGS. 1 to 6 arrow labels 1 which have been taken from the magazine 2 may be automatically inserted into the center holes of balls of yarn or thread. A motor-operated winding mandrel 12 is rotatably mounted on a machine frame 11 of the device. A ball, skein or package 13 of yarn or thread may be wound onto this mandrel, for example with the aid of a flyer which is not illustrated. Also mounted on the machine frame 11 is an endless conveyor belt 14, which transports balls in a direction at right angles to the plane of drawing in FIGS. 1 to 6. A plurality of cup-shaped carrier members 15 having two upwardly projecting side walls 16 are arranged on the conveyor belt 14. A gripping device 17 serves to transfer the ball 13 from the winding mandrel 12 to the conveyor means consisting of the conveyor belt 14 and the carrier members 15. The gripping device 17 is displaceable along a guide rail 18 mounted on the machine frame 11 and may be moved back and forth in the known way between the winding mandrel 12 and the conveyor belt 14 by means of a motor-operated lever system which is not illustrated. The gripping device 17 has two gripper members 21, 22 which are displaceable along a rod 23, for example by means of a pneumatic drive.

An additional rod 24 is mounted on the machine frame 11 so as to be stationary and in vertical alignment. Two hooks 25, 26 are displaceable along this rod by means of a pneumatic drive which is also not illustrated. These hooks together form a pair of pincers.

A label conveyor 27 is mounted for displacement on the machine frame 11 in the vicinity of the magazine 2. The conveyor comprises a relatively long rod 28 and a suction bar 29 articulatedly disposed at the free front end of the rod. The suction bar 29 which has one or more suction heads connected to a low pressure or suction source may be moved by means of, for example, a pneumatic drive (not illustrated) from the position illustrated in FIG. 1 by solid lines into the position illustrated by dash-dot lines, in which the suction bar 29 engages on the underside of the lowest arrow label of the stack. The lowest label will adhere to the suction bar 29 due to the suction generated therein and is carried on the bar when it swings back into its position shown by the solid lines in FIG. 1.

Figure 2:
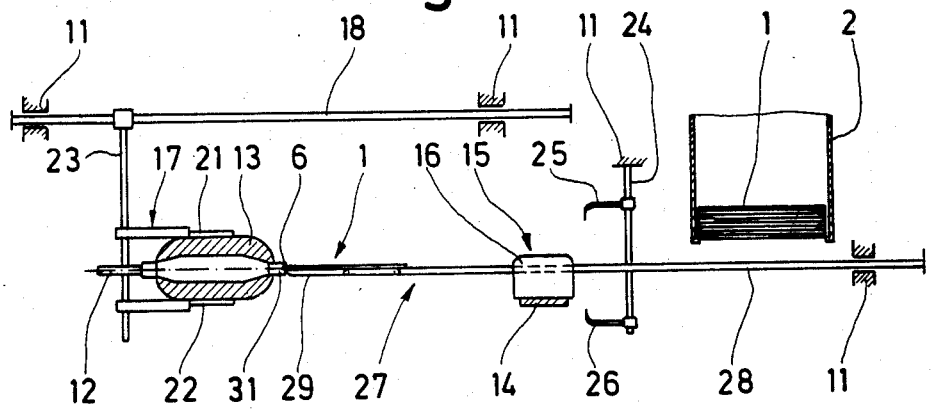

In FIG. 2, the rod 28 of the label conveyor 27 is moved to the left towards the winding mandrel 12. The suction bar 29 carries an arrow label 1 withdrawn from the stack in the magazine 2, this label being held on the suction bar 29 by the low pressure still prevailing therein. The arrow label 1 is positioned with its tip 6 (FIG. 7) to the fore and in substantially coaxial alignment with the winding mandrel 12 in the immediate vicinity of the free end of this mandrel. The free end of the winding mandrel 12 bears a tubular extension 31, into which the tapering end of the suction bar 29 and the arrow tip 6 penetrate slightly. This ensures an exact positioning of the arrow label 1 relative to the winding mandrel 12 and the ball 13. This means that, in particular, no threads will get caught when the ball 13 is later moved onto the label 1.

Figure 1:
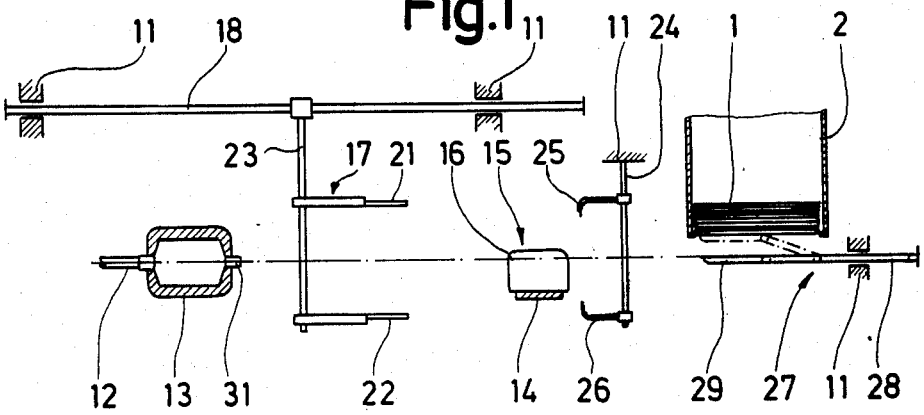

The winding mandrel 12 can be opened out and closed up in the known way, similar to an umbrella. FIG. 1 shows the mandrel in its opened position, in which the ball 13 is wound onto the mandrel. In FIG. 2, the winding mandrel 12 is folded together to facilitate removal of the wound ball 13. The gripping device 17 has, in the meantime, been moved automatically to the left along the guide rail 18 so that the gripper members 21, 22 are positioned above and below the ball 13. The two gripper members 21, 22 are now moved towards one another to engage on the ball 13 and press it lightly together.

Figure 3:
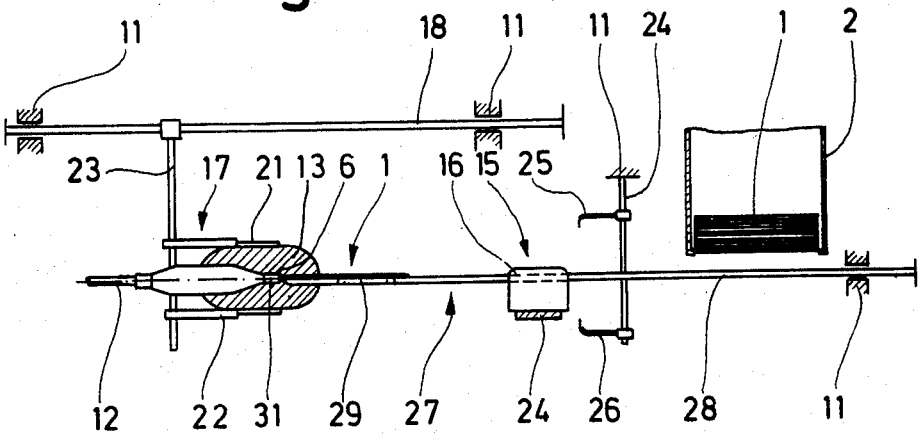
Figure 4:
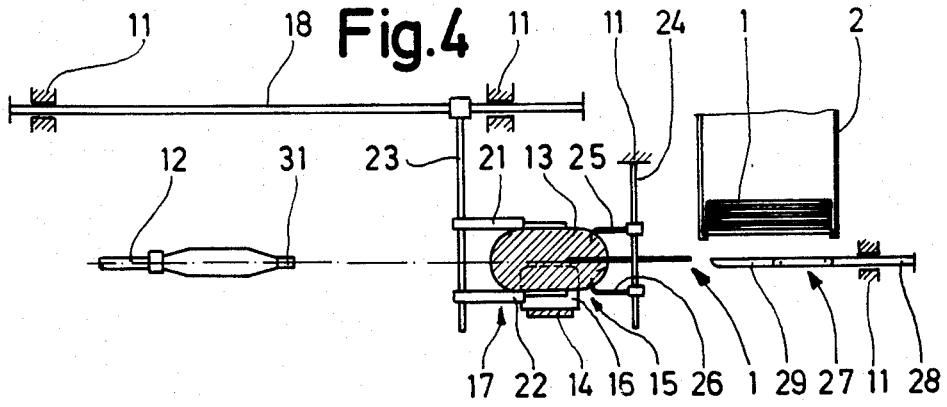

When the gripping device 17 is again moved to the right, in accordance with FIG. 3, towards the conveyor belt 14, the gripper members 21, 22 engaging on the ball 13 carry this ball 13 with them, thereby withdrawing it from the winding mandrel 12 and sliding the ball with its center hole onto the shaft 5 (FIG. 7) of the arrow label 1 held stationary on the suction bar 29. The free end of the suction bar 29 hereby penetrates into the center hole of the ball 13 to facilitate insertion of the arrow shaft 5.

Subsequently, the gripping device 17 is moved to the right (cf. FIG. 4), together with the ball 13 held in the gripping device and the label conveyor 27, until the ball 13 is positioned over one of the cup-shaped carrier members 15 on the conveyor belt 14. The gripping device 17 is now stopped whereas the label conveyor 27 is moved further to the right and the low pressure in the suction bar 29 simultaneously switched off. The arrow label 1 is then released from the suction bar 29 and remains in the center hole of the ball 13 on account of its barbs 7 (FIG. 7). The two hooks 25, 26 are now moved towards one another along the rod 24 so that they penetrate the ball 13 and hold it firmly between them.

Figure 5:
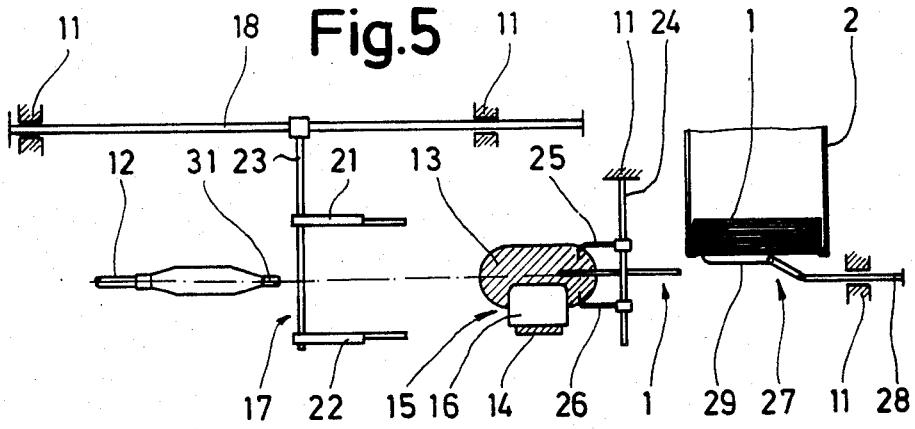
Figure 6:
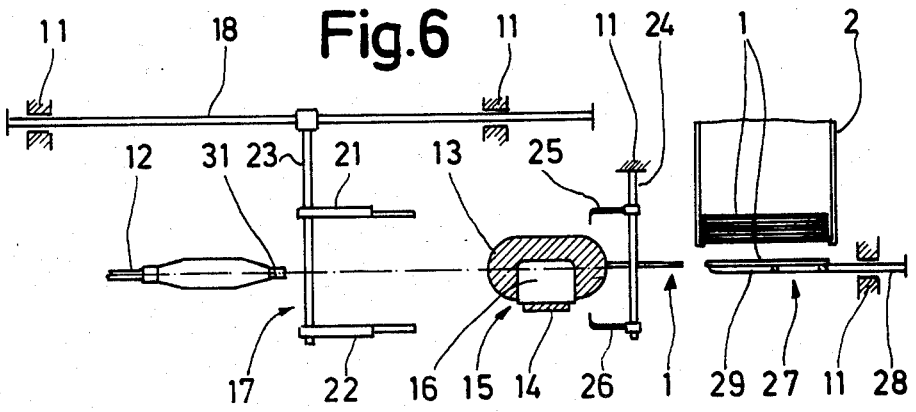

Once the gripper members 21, 22 have been moved apart, the gripping device 17 is moved back as shown in FIG. 5 while the ball held by the hooks 25, 26 remains positioned over the carrier member 15. In the meantime, the suction rod 29 collects the next arrow label from the stack in the magazine 2 and the hooks 25, 26 are moved apart (FIG. 6) so that the ball 13 with the arrow label 1 inserted therein drops into the carrier member 15 and is transported away by the conveyor belt 14 at right angles to the plane of drawing. Once the winding mandrel 12 has been opened out again, a new ball 13 can be wound onto it and provided in the way described with the next arrow label 1 lying ready on the suction bar 29.

Before the labelled ball 13 is packaged it may be mechanically pressed together in the known way to form a flat package. The label portion 3 is hereby folded along the line 8 and may be laid flat against one end face of the ball or package.

It is customary for one and the same ball winding machine to have a plurality of winding stations arranged adjacent one another and each having a winding mandrel 12 and a gripping device 17. In accordance with the invention, each winding station is provided with a label magazine 2 and a label conveyor 27. In this way, it is possible to provide all the balls of a prepared batch of, for example, 10 or 20 balls with arrow labels at the same time and subsequently transport them away.

In the device illustrated in FIGS. 1 to 6, the gripping device 17 and the label conveyor 27 are essentially coaxial and disposed for linear sliding displacement. In another embodiment of the invention, the gripping device may also be pivotally mounted for the purpose of transferring the ball 13 withdrawn from the winding mandrel 12 to the conveyor belt 14. In this case, the label conveyor 27 with the suction bar 29 need not be moved along the same path as the gripping device 17. The different paths of motion of the gripping device 17 and the label conveyor 27 must coincide merely in the immediate vicinity of the free end of the winding mandrel 12 so that the arrow label is duly positioned and the gripping device 17 can slide the ball 13 onto the shaft 5 of the label. For operating procedures this means that after the suction bar 29, which moves along a different path to the gripping device 17, has reached the operating position shown in FIG. 3 it must be displaced away from the labelled ball at a higher speed than the gripping device so as to move out of the path of the gripping device 17 moving towards the conveyor belt 14. Alternatively, the suction bar 29 and the gripping device 17 may also be moved out of their operating positions shown in FIG. 3 one after the other. In this case, the low or suction pressure is switched off, the suction bar 29 is drawn out of the center hole of the ball 13 and moved out of the way, whereupon the gripping device 17 then transfers the ball 13 to the conveyor belt 14.

What is claimed is:

1. A device for automatically attaching an arrow label in the center hole of a ball, skein, or a package of yarn or thread, said device comprising a winding mandrel having a free end for winding said yarn into a ball, a movable label conveyor means for positioning one arrow label at a time, tip first, in the immediate vicinity of the free end of the winding mandrel and aligning said arrow label with the center hole of the ball, gripping means for gripping said ball while on said mandrel, and means for moving said gripping means to withdraw the ball of yarn from the winding mandrel, for sliding it onto the shaft of the arrow label and for transferring the ball with the label to a conveyor means.

2. The device of claim 1 further comprising a magazine having a support of arrow labels therein and wherein the label conveyor means includes a suction bar for withdrawing labels one at a time from the magazine.

3. The device of claim 1 wherein the winding mandrel includes a tubular extension and wherein the label conveyor means includes a free end for insertion into the tubular extension during positioning of the arrow label at said winding mandrel.

4. The device of claim 2 wherein the winding mandrel includes a tubular extension and wherein the label conveyor means includes a free end for insertion into the tubular extension during positioning of the arrow label at the winding mandrel.

* * * * *